United States Patent [19]

Haydt

[11] 4,285,358

[45] Aug. 25, 1981

[54] SERVOVALVE FEEDBACK WIRE INTERFACE CONFIGURATION

[75] Inventor: Richard J. Haydt, Los Angeles, Calif.

[73] Assignee: Textron Inc., Providence, R.I.

[21] Appl. No.: 111,515

[22] Filed: Jan. 14, 1980

[51] Int. Cl.[3] ..... F15B 13/16

[52] U.S. Cl. ..... 137/85; 91/365; 91/387; 137/625.64; 403/115; 403/122

[58] Field of Search ..... 91/365, 387; 137/85, 137/625.61, 625.62, 625.63, 625.64; 403/115, 122

[56] References Cited

U.S. PATENT DOCUMENTS 3,584,649 6/1971 Cobb ..... 137/625.64 X 3,814,131 6/1974 Takahashi et al. ..... 137/625.62

*Primary Examiner*—Gerald A. Michalsky

*Attorney, Agent, or Firm*—Nilsson, Robbins, Dalgarn, Berliner, Carson & Wurst

[57] ABSTRACT

An improvement in a servovalve employing spool-valve-position feedback provided by a feedback spring, wherein the feedback spring centerline is not aligned vertically with the center line of the spool valve, comprising a receiving hole in the spool valve body and a slot in the spool for feedback spring clearance; a pin or ball rigidly attached to the feedback spring with the portions of the pin or the ball which contact the sides of the receiving hole fitting in face to face relation to the inner surface of recesses formed in the slot by the hole.

8 Claims, 4 Drawing Figures

FIG. 1
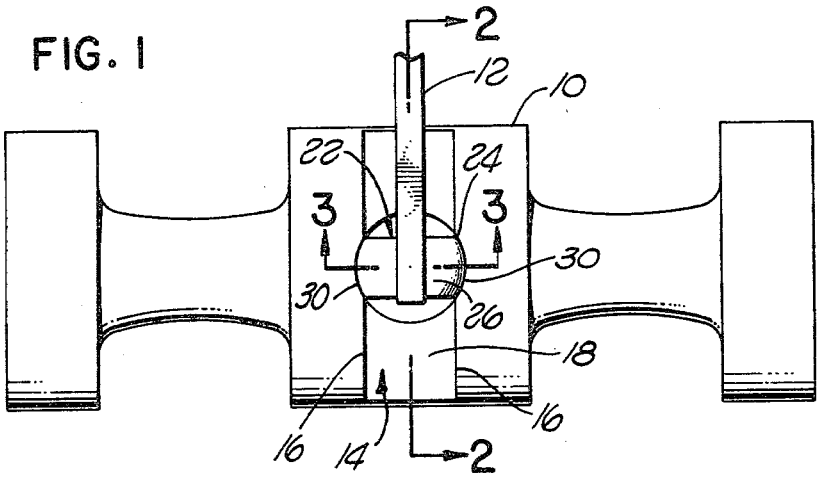
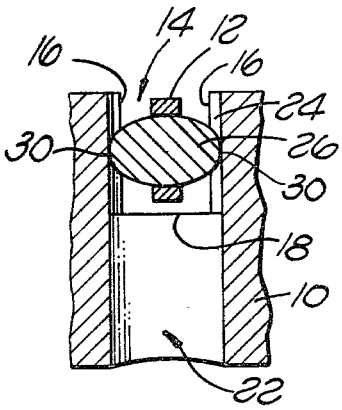
FIG. 3
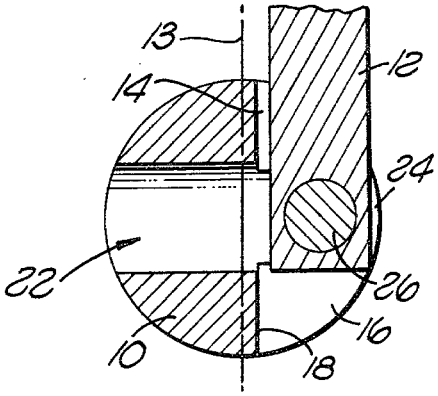
FIG. 2
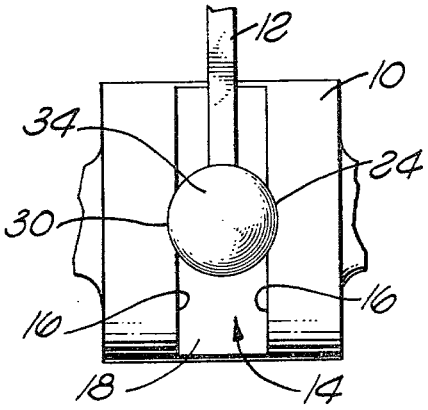
FIG. 4

SERVOVALVE FEEDBACK WIRE INTERFACE CONFIGURATION

BACKGROUND OF THE INVENTION

This invention relates generally to a novel spool valve off-center feedback spring arrangement having specific utility in the servovalve art. More particularly, this invention concerns an improvement in servovalves having spool-valve-position feedback provided by a feedback spring, wherein the feedback spring is not aligned vertically with the center line of the spool valve. In the past it has been common to sense spool position in hydraulic spool valves by providing a mechanicallinkage in the form of a feedback spring in contact with a portion of the spool. As the spool moves the feedback spring typically pivots about a pivot point and provides a feedback signal to, e.g., a torque motor, which in turn is controlling the direction of hydraulic fluid to one side or the other of the spool, causing the spool valve to move a desired amount in a desired direction.

The feedback spring typically has a ball attached to the end of the feedback spring, with at least portions of the surface of the ball contacting the spool. In one prior art arrangement, wherein the feedback spring cannot be positioned, or is undesirably positioned, so that the longitudinal axis of the feedback spring, in the vicinity of the spool, is aligned with a cross-sectional diameter of the spool, a groove is typically formed around the circumference of the spool having a width equal to the diameter of the ball. The ball then rests in the groove and as the spool moves the feedback spring thus is also caused to move in the same direction. The disadvantage of this arrangement is that the contact between the inner walls of the groove and the surface of the ball is a point contact on each side of the wall. Point contact, coupled with high feedback spring loads, accelerates the wear to both the surface of the groove and the surface of the ball at the point of contact, ultimately causing an improper feedback signal when the ballgroove interface clearance is increased.

In addition, in this type of arrangement the spool will typically tend to rotate around its longitudinal center line axis, thus exacerbating the wear problem described immediately above.

One manner of solving the wear problem is shown in the patent to Cobb, U.S. Pat. No. 3,584,649. FIG. 2 of that patent shows a feedback spring arrangement in which the ball extends into a hole in the spool. This eliminates the point contact problem since the ball and hole have the same diameter and also eliminates the spool rotation problem. However, this arrangement can only be used when the center line of the hole corresponds with a cross-sectional diameter of the spool and the feedback spring extends into the hole generally along the center line of the hole.

Further, in many spool valve applications it is impractical or undesirable to extend the feedback spring downwardly into a hole in the spool, which hole has a center line corresponding with a cross-sectional diameter of the spool, and where the feedback spring extends generally along the center of the hole. Thus, it is often more desirable to employ an off-center feedback spring, which prior to the present invention resulted in the necessity to accept the undesirable effects of wear on feedback spring ball noted above, due to point contact between the feedback spring ball and the walls of the groove in the spool, and rotation of the spool valve.

It can therefore be seen that while such prior art arrangements have exhibited some degree of utility in accomplishing the desired feedback responsive to the motion of the spool valve, some room for significant improvement remains.

The problems enumerated in the foregoing are not intended to be exhaustive, but rather are among many which tend to impair the effectiveness of previously known feedback spring arrangements. Other noteworthy problems may also exist; however, those presented above should be sufficient to demonstrate that feedback spring arrangements appearing in the art have not been altogether satisfactory.

SUMMARY OF A PREFERRED EMBODIMENT OF THE INVENTION

Recognizing the need for an improved feedback spring-spool interface arrangement, it is, therefore, a general object of the present invention to provide a novel feedback spring-spool interface arrangement which minimizes or reduces the problems of the type previously noted.

A feature of the present invention resides in the feedback spring having a head, which may be a rigidly attached pin or an attached ball, the head having a bearing surface which fits in face to face relation to the inner surfaces of a recess in each of two side walls of a slot cut in the spool with the slot having a sufficient depth to prevent contact between the feedback spring and the spool when the head is positioned in the slot.

A further feature of the present invention resides in a slot cut through the spool and a receiving hole extending along a cross-sectional diameter of the spool and intersecting the slot, thereby forming a recess in each of the side walls of the slot.

Another feature of the present invention resides in either a pin rigidly attached to the feedback spring, or a ball attached to the feedback spring.

Yet another feature of the present invention resides in the pin or ball being inserted into the receiving hole with the bearing surface of the pin or ball fitting in face to face relation to the inner surface of the recesses formed in the side walls of the slot by the hole.

Yet another feature of the present invention resides in the pin or ball being inserted into the receiving hole with the bearing surface of the pin or ball fitting in face to face relation to the inner surface of the recesses formed in the side walls of the slot by the hole.

Still another feature of the present invention resides in eliminating the point contact between the feedback spring ball of the prior art and the groove of the prior art, having the bearing surface on the pin or ball be of the same shape and dimension as the inner surface of the recesses in the slot side walls of the present invention, inserting the pin or ball into the recesses in the slot side walls and rotating the feedback spring until the feedback spring and spool are in their normal operating positions, thereby locking the spool against further rotation.

A still further feature of the present invention resides in the recesses having a longitudinal axis aligned with the radius of the spool at the midpoint of the arc of the circumference of the spool valve body defined by the slot.

Examples of the more important features of the present invention have thus been summarized rather broadly in order to facilitate the understanding of the detailed description thereof that follows, and in order that the contribution to the art may be better appreciated. There are, of course, additional features of the invention that will be described herein and which will also form the subject of the claims appended hereto. These features and advantages of the present invention will become apparent with reference to the following detailed description of the preferred embodiments thereof in connection with the accompanying drawings, wherein like reference numerals have been applied to like elements, and in which:

BRIEF DESCRIPTION OF THE DRAWINGS

FIG. 1 depicts a side view of the feedback spring-spool arrangement of the present invention;

FIG. 2 depicts a sectional view along lines 2—2 of FIG. 1;

FIG. 3 depicts a sectional view along lines 3—3 of FIG. 1;

FIG. 4 depicts a side view of an alternative embodiment of the present invention.

DETAILED DESCRIPTION OF A PREFERRED EMBODIMENT OF THE INVENTION

Turning first to FIG. 1, the feedback spring-spool arrangement of the present invention is shown. The spool 10 has associated with it a feedback spring 12 which provides a mechanical linkage for feeding back the spool 10 position to a control mechanism (not shown) containing a torque motor (not shown) which controls the application of hydraulic fluid to the desired portion of the spool 10 for moving the spool 10 in a desired direction to a desired position.

A slot 14 is cut through a portion of the spool 10 and has opposed sidewalls 16 and a third wall 18. As is shown more particularly in FIGS. 2–3, the slot 14 is cut so that the third wall 18 forms a cord of the circumference of the spool body 10 which is less than the cross-sectional diameter of the spool body 10, and, therefore, the third wall 18 is displaced from a cross-sectional diameter 13 of the spool body 10 which is parallel to the third wall 18.

A hole 22 extends into spool 10 and intersects the slot 14 and the third wall 18. In the embodiment shown, the hole 22is perpendicular to the third wall 18. However, it will be appreciated by those skilled in the art that the hole need not be perpendicular to third wall 18 and may intersect the third wall 18 at any angle greater than 0° and less than 180°.

The hole 22 has an internal surface 24 which is circular and has a preselected diameter. In the vicinity of the slot 14 where the slot 14 and hole 22 intersect, due to the diameter of the hole 22 being larger than the width of the slot 14, there are formed, in each of the sidewalls 16, recesses having a longitudinal axis aligned with a radius of the spool 10.

In the embodiments shown in FIGS. 1–3, a pin 26 is rigidly attached to the feedback spring 12 by any means known to the art. The pin 26 has a bearing surface 30 which abuts the recesses 24 formed by the hole 22 intersecting the slot 14. The bearing surface 30 has the same shape and dimension as the adjacent portion of recesses 24, i.e., in the illustrated embodiment of FIGS. 1–4, the same radius of curvature as the circular hole 22 and the recesses 24.

It can therefore be seen that when the pin 26 is inserted into the hole 22 and the spool 10 is rotated until the feedback spring is in its normal off-center position and at its proper extension, the pin 26, with its bearing surfaces 30 engaging the respective recesses 24, prevents rotation of the spool 10 because of the moment arm resulting from the longitudinal axis of the feedback spring 12, in the vicinity of the spool 10, being unaligned with any cross-sectional radius of the spool 10. The third wall 18 of the slot 14 is shaped and located as desired so as not to significantly detract from the necessary structural integrity of the spool valve body, while at the same time preventing contact between the feedback spring 12 and the third wall 18 in the normal operating position of the feedback spring 12.

It will be understood that this arrangement leaves a certain amount of flexibility in the tolerances of the component parts of the feedback spring 12 and its associated mountings (not shown). For example, if the feedback spring 12 is too long or too short, the slot 14 allows the spool 10 to be rotated slightly in the necessary direction (with a corresponding shifting of the position of pin 26 in the recess 24) to achieve the anti-rotational locking effect of the pin 26 in the recesses 24, but still without the feedback spring 12 contacting the third wall 18. The function of the slot 14 is thus to allow the feedback spring 12 to be rotated about the center of the pin 26 while at the same time rotating the spool valve body 10 until the feedback spring 12 is in its normal operating position and at its normal extension, thereby locking the spool 10 from further rotation. The anti-rotational locking occurs due to the bearing surface 30 on the pin 26 engaging the recesses 24 at some moment arm distance from the longitudinal axis of the spool 10.

Turning now to FIG. 4, an alternative embodiment of the present invention is shown. In this embodiment, the pin 26 is replaced by a ball 34 attached to the feedback spring 12 and having a diameter equal to that of the hole 22. Thus, the contact between the recesses 24 and the bearing surface 30 on the ball 35 extends along the circumference of the ball. This eliminates the point contact problem of the prior art. In the embodiment shown in FIG. 4, the ball 34 is inserted into the hole 22 and the ball 34 and feedback spring 12 are then rotated until the feedback spring 12 is in its proper operating position. This corresponds to the position of the feedback spring 12 shown in FIG. 2 with the feedback spring 12 not in contact with the third wall 18.

The pin 26 or ball 34 forms a head on the feedback spring 12 having a bearing surface 30 which fits in face to face relation to the recesses 24. It will be appreciated that the pin or ball may be formed integrally with the feedback spring if desired. It can thus be seen that when the pin 26 or ball 34 is in the recesses 24 and the spool 10 and feedback spring 12 are in the normal operating positions, there is a face to face contact between the bearing surface of the pin 26 or ball 34 and the recess 24. This eliminates the point contact problem of the prior art.

By way of an example of the criticality of tolerances in the spool valve art an example of the dimensions of certain portions of the feedback spring 12 and head (pin 26 or ball 34) will be given. In one example illustrated in FIGS. 1–3 the feedback spring 12 has a width of 60/1000 of an inch and a thickness of 20/1000 of an inch and the hole 22 has a diameter of 50/1000 of an inch so that the bearing surface 30 of the pin 26 has the same radius of curvature and the ball 34 has the same 50/1000 of an inch diameter. The illustrations in FIGS. 1–4 are not, therefore, drawn exactly to scale, but are enlarged to better illustrate the features of the present invention.

SUMMARY OF THE ADVANTAGES AND SCOPE OF THE INVENTION

It will be appreciated that in constructing a feedback spring-spool interface arrangement according to the present invention, certain significant advantages are provided. In particular, in those applications where the feedback spring 12 is desirably not positioned such that its longitudinal axis extends along a cross-sectional diameter of the spool 10, the present invention eliminates the point contact between the pin 26 or ball 34, forming the head at the end of the feedback spring 12, and the inner surfaces of the groove. In the prior art this extended circumferentially around the spool body 10. Also eliminated is the possibility of rotation of the spool body 10, thus decreasing the wear on the interface between the pin 26 or ball 34 and the inner surfaces of the groove used in the prior art. In the present invention the elimination of rotation decreases the wear on the bearing surface 30 of the pin 26 or ball 34.

The foregoing description of the invention has been directed to a particular preferred embodiment in accordance with the requirements of the Patent Statutes and for purposes of explanation and illustration. It will be apparent, however, to those skilled in this art that many modifications and changes in both apparatus and method may be made without departing from the scope and spirit of the invention. For example, the hole 22 need not be extended entirely through the spool body 10, but only need extend sufficiently into the spool body 10 to allow the pin 26, or, in the alternate embodiment, the ball 34, to extend into the hole 22 a sufficient amount, such that the pin 26 or ball 34 at the end of the feedback spring 12 engages the recesses 24 at some distance from the longitudinal center axis of the spool 10, and such that feedback spring 12 does not contact the third wall 18 of slot 14. In addition, the particular shape of the feedback spring 12, the pin 26 or ball 34 and the manner of connecting the pin 26 or the ball 34 to the feedback spring 12 form no part of the present invention except to the extent that the bearing surfaces of the pin 26 or ball 34 must be of the same shape and dimensions as the portion of the surface of the recesses 24 which they contact.

These, and other modifications of the invention will be apparent to those skilled in the art. It is the Applicant's intention in the following claims to cover all such equivalent modifications and variations as fall within the spirit and scope of the invention.

What is claimed is:

1. In a servovalve having spool-valve-position feedback provided by a feedback spring in contact with a portion of the spool valve body, the improvement comprising:

a spool valve body having a slot therein, said slot having first and second side walls, said first and second side walls each having a recess therein, each said recess having an inner surface;

a feedback spring having a head insertable into said slot, said head having bearing surfaces which fit in face to face relation with said inner surface of each of said recesses; and said slot being of sufficient depth to prevent contact between the feedback spring and the spool valve body.

2. The apparatus of claim 1 wherein said head comprises a pin rigidly attached to the feedback spring.

3. The apparatus of claim 1 wherein said head comprises a ball attached to said feedback spring.

4. The apparatus of claims 2 or 3 wherein each said recess has a longitudinal axis aligned with a radius of the spool valve body at the mid-point of an arc of the circumference of the spool which is defined by said slot.

5. The apparatus of claim 2 wherein said inner surface of each of said recesses has a radius of curvature and said bearing surface has the same radius of curvature.

6. The apparatus of claim 3 wherein said inner surface of each of said recesses has a radius of curvature and said ball has the same radius of curvature.

7. The apparatus of claims 5 or 6 wherein each said recess has a longitudinal axis aligned with a radius of the spool at the mid-point of an arc of the circumference of the spool which is defined by said slot.

8. The apparatus of claim 3 wherein said ball is rigidly attached to the feedback spring.

* * * * *